United States Patent [19]

Curtis et al.

[11] 4,448,137

[45] May 15, 1984

[54] MODULAR HOOK BAR WITH GAUGE INSERT FOR TUFTING MACHINE

[75] Inventors: Kenneth C. Curtis; John C. Densmore, both of Dalton, Ga.

[73] Assignee: Tuftco Corporation, Chattanooga, Tenn.

[21] Appl. No.: 447,974

[22] Filed: Jan. 26, 1983

[51] Int. Cl.[3] ..... D05C 15/00

[52] U.S. Cl. ..... 112/79 R

[58] Field of Search ..... 112/19 R, 79 FF, 79 R

[56] References Cited

U.S. PATENT DOCUMENTS

| | | | |
|---|---|---|---|
| 4,193,359 | 3/1980 | Beasley | 112/79 R |
| 4,217,837 | 8/1980 | Beasley | 112/79 R |
| 4,354,441 | 10/1982 | Hurst | 112/79 R |
| 4,375,196 | 3/1983 | Beasley | 112/79 R |

FOREIGN PATENT DOCUMENTS 2827008 1/1980 Fed. Rep. of Germany .

*Primary Examiner*—Ronald Feldbaum

*Attorney, Agent, or Firm*—Harrington A. Lackey

[57] ABSTRACT

A modular looper apparatus for a multiple-needle tufting machine including a modular hook bar made of solid material and including a transversely extending recess opening through the front face of the hook bar. Transverse gauge bars or members having transversely spaced vertical hook slots opening through the front and bottom portions of the gauge bar are inserted within the recess for receiving the shank portions of the corresponding looper hooks, in operative position. The looper hooks are locked in their operative positions by set screws extending upward through the bottom portion of the hook bar, into the recess and in vertical alignment with the corresponding hook slots.

7 Claims, 3 Drawing Figures

MODULAR HOOK BAR WITH GAUGE INSERT FOR TUFTING MACHINE

BACKGROUND OF THE INVENTION

This invention relates to a multiple-needle tufting machine, and more particularly to a modular looper apparatus for a multiple-needle tufting machine.

The conventional hook bars for multiple-needle tufting machines are long bars extending transversely of the machine below the needles and the base fabric. A conventional cut-pile hook bar has deeply elongated slots formed through its bottom face and uniformly spaced for receiving the hooks which cooperate with the needles to form loops in the yarns carried by the needle. For a narrow gauge, multiple-needle tufting machine, the looper slots in the hook bar must be formed close together. The closeness of the spacing of the looper slots is limited by the thinness of the walls between the slots. Conventional loopers or hooks are held in their respective slots by individual set screws which are threaded into each slot and engage the opposed walls or lands of the slots. Thus, the thinness of the walls is further limited by the diameters of the set screws. Moreover, the threaded movement of the set screws tends to expand and warp the slot walls or lands.

One solution to spacing the looper slots closer together in a narrow gauge tufting machine is disclosed in the prior U.S. Pat. No. 3,635,177, issued to Larry P. Gable, et al for NARROW GAUGE HOOK BAR FOR TUFTING MACHINE on Jan. 18, 1972. The Gable patent discloses a hook bar having uniformly spaced, but staggered, looper slots formed alternately in the front and rear faces of the hook bar. Thus, the staggered front and rear slots receive two transverse rows of staggered hooks or loopers for cooperation with corresponding staggered needles. However, the hook bar disclosed in the Gable patent was primarily designed for a looper apparatus for forming narrow gauge loop pile.

Another method of spacing the hook slots closer together in a narrow gauge tufting machine is disclosed in U.S. Pat. No. 4,067,270 of Hoyt E. Short for "NARROW GAUGE CUT PILE TUFTING APPARATUS," in which the needles are staggered and the loopers are made quite thin and flexible for bending and veering around each of the corresponding staggered needles.

A further solution for spacing loopers and hook slots closer together in a narrow gauge machine is disclosed in U.S. Pat. No. 4,158,339 of Hoyt E. Short, issued June 19, 1979, for "NARROW GAUGE CUT PILE LOOPER APPARATUS." In this narrow gauge cut-pile tufting machine, the needles are staggered and the slots are formed in the front and rear faces of the hook bar. However, the slots are designed to extend along the top of the hook bar to receive and reinforce the elongated body portions of the specially constructed looper hooks.

Another type of hook bar or looper apparatus for mounting a plurality of looper hooks close together in order to provide a more narrow gauge for multiple-needle tufting machines, is disclosed in U.S. Pat. No. 4,217,837, of Max M. Beasley et al, issued Aug. 19, 1980, for "FINE GAUGE LOOPER APPARATUS FOR IN-LINE TUFTING MACHINE." In this looper apparatus, the hook slots are formed in an insert bar received in the front face of the hook bar, and the looper hooks are held in position by a plurality of clamp members threadedly secured to the hook block and against the front body portions of the looper hooks. The hook bars are made in the form of elongated modules which are mounted end-to-end and each of the clamp members is adapted to secure a limited number of hooks upon the hook bar module.

In recent times, a plurality of thin hooks have been mounted securely and precisely in a hook bar by casting the metal forming the hook bar around the pre-set hooks. However, although strength, rigidity, and precision are attained, nevertheless an entire cast module of hooks must be discarded if only a single hook becomes defective.

Several modular hook bars of solid material having various hook slot constructions for receiving the rearward projecting shank portions of looper hooks, are disclosed in the pending application of Max M. Beasley et al, Ser. No. 397,793, filed July 13, 1982, for "MODULAR LOOPER APPARATUS FOR NARROW GAUGE TUFTING MACHINE." This application is assigned to Tuftco Corporation, the same assignee of the instant application. Although the various hook bar structures disclosed in application Ser. No. 397,793 operate generally satisfactorily, nevertheless various difficulties have been encountered with such hook bar structures under actual operation conditions, such as warpage or bending of parts of the hook bar, disalignment of the looper hooks, and/or distortion of the looper hooks or the retaining parts of the hook bar.

SUMMARY OF THE INVENTION

It is therefore an object of this invention to provide in a multiple-needle tufting machine, particularly adapted for cut-pile tufting, an improved looper apparatus having a solid, stable hook bar with special means for securing the hooks within the hook bar.

The looper apparatus made in accordance with this invention is adapted for utilization in staggered needle cut pile tufting machines or in-line (single needle row) tufting machines having coarse gauges or narrow gauges in the order of 5/64th of an inch or greater.

More specifically, the looper apparatus made in accordance with this invention includes a plurality of elongated hook bar modules made of solid material, specifically steel, each hook bar having an elongated transverse recess opening forward for receiving transverse gauge bars having hook slots for retaining the shank portions of the corresponding hooks. A plurality of set screws project, preferably at an angle, rearward and upward from the front face of the hook bar to individually engage the bottom edges of the shank portions of corresponding looper hooks within the recess. The set screws are threaded through solid portions of the hook bar beneath these slots until the free ends of the set screws penetrate the recess to firmly engage the bottom edges of the respective shank portions of the looper hooks.

Each gauge bar is approximately the same dimension as the recess in which it is fitted or inserted, except that its height is slightly less than the height of the recess. The hook slots in each gauge bar are transversely spaced in vertical planes at the same gauge as the needle gauge, and extend forwardly and rearwardly, as well as opening through the bottom of the gauge member. The upper ends of the hook slots are closed and defined by the bottom surface of the continuous transversely extending top wall of the gauge member. Thus, when a shank portion of a looper hook is inserted within its corresponding hook slot within the recess, the shank portion occupies substantially the full height of the slot and recess between the top wall of the gauge member and the bottom surface of the recess. When the set screws bear against the bottom edges of the shank portions of the looper hooks, the top edges of the shank portions are forced into bearing engagement against the upper surfaces of the hook slots defined by the top wall of the gauge member.

In a preferred form of the invention, the body portion or neck portion of each looper has a rearwardly facing, vertical rear shoulder which snugly engages the front face of the hook bar above the recess for stabilized support of the looper hooks. Moreover, transversely spaced lands project from the front face on opposite sides of the neck portion of the looper hook for further stabilizing the looper hooks. These lands define vertical grooves between the lands which are in the same vertical planes as corresponding hook slots.

In a tufting machine incorporating a modular hook bar made in accordance with this invention, individual looper hooks, as well as independent modular hook bars, may be inserted, removed, or replaced, in the looper apparatus.

DESCRIPTION OF THE PREFERRED EMBODIMENTS

Figures 1, 2, 3:
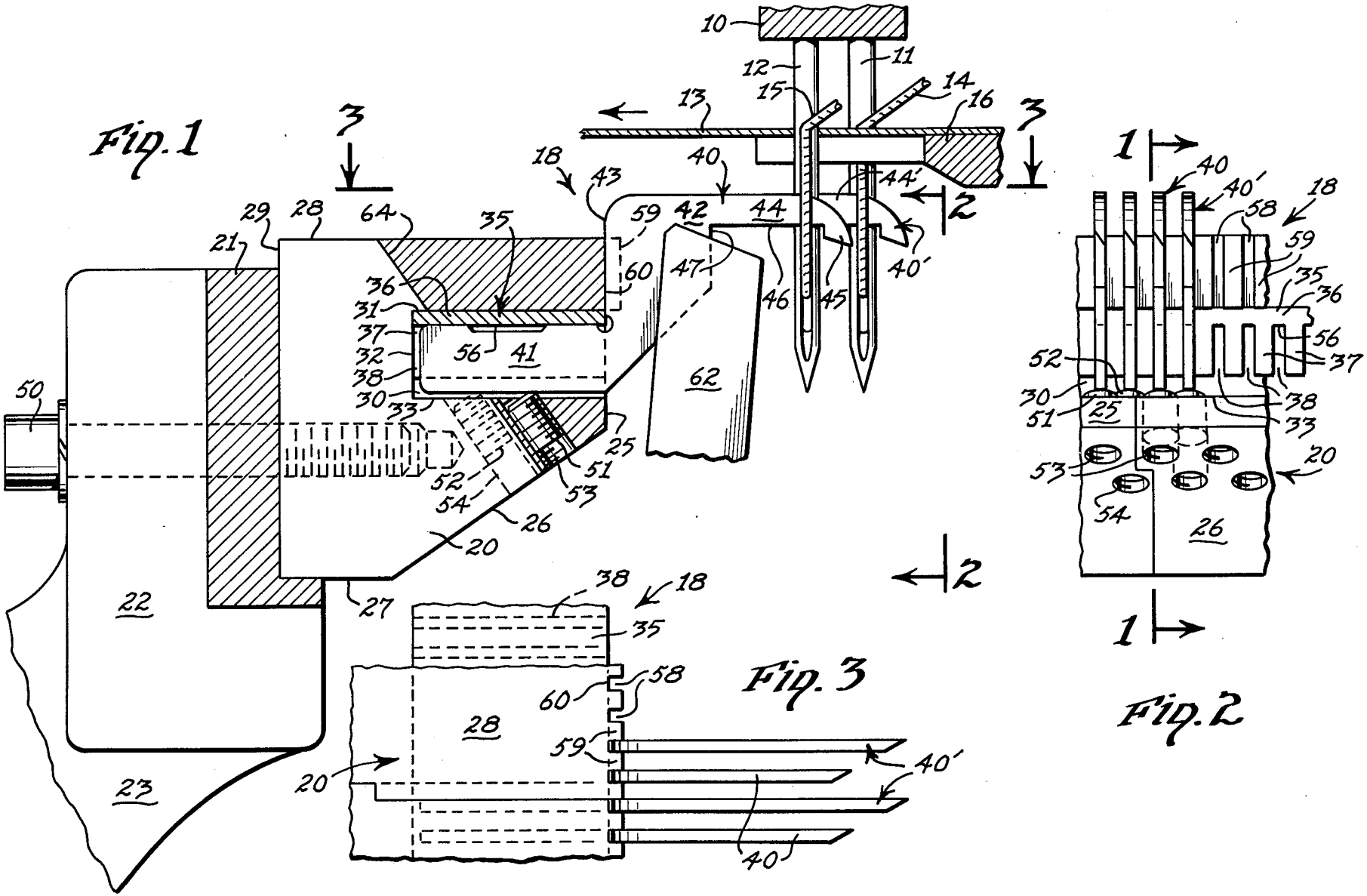
FIG. 1 is a fragmentary sectional elevation taken along the line 1—1 of FIG. 2, longitudinally through a portion of a narrow gauge, staggered-needle tufting machine, incorporating a cut-pile looper apparatus made in accordance with this invention, and disclosing the needles and looper hooks in operative loop-forming positions.
FIG. 2 is a fragmentary, front elevation of the looper apparatus, taken along the line 2—2 of FIG. 1.
FIG. 3 is a fragmentary top plan view of the looper apparatus, taken along the line 3—3 of FIG. 1, with portions broken away.

Referring now to the drawings in more detail, FIG. 1 discloses a transverse needle bar 10 in a conventional multiple-needle tufting machine supporting a first row of uniformly spaced front needles 11 and a second row of uniformly spaced rear needles 12 offset preferably mid-way between the front needles 11, to provide a uniform, narrow gauge, staggered needle tufting machine. The needle bar 10 is vertically reciprocated by conventional means, not shown, to cause the front and rear needles 11 and 12 to move between an upper position above the base fabric 13 to a lower position penetrating the base fabric 13, so that the needles will carry yarns, such as yarns 14 and 15, through the base fabric 13 to form loops of tufting therein. The base fabric 13 is supported upon a needle plate 16 for movement, by means not shown, in the direction of the arrow of FIG. 1, that is longitudinally from front-to-rear through the machine.

The looper apparatus 18 which cooperates with the needles 11 and 12 includes a transverse hook bar 20 of unique construction fixed upon an elongated shim bar 21, which in turn is supported upon a bracket 22 corresponding with a rocker arm 23 journaled on a rock shaft, not shown, and driven by conventional means connected to the rocker arms 23 for limited reciprocal movement in synchronism with the reciprocal movements of the needles 11 and 12.

The hook bar 20 has an upper portion and a lower portion and a front face which includes an upper front face portion 25, a lower angular front face portion 26 and a bottom surface 27. The hook bar 20 also includes a top surface 28 and a rear vertical transverse surface 29.

Formed in the solid metal hook bar or hook bar module 20 is an elongated transversely extending recess 30 which opens forward through the upper face portion 25, and is open in the transverse direction of the recess 30, but is otherwise enclosed to form the top surface 31, rear surface 32, and bottom surface 33.

Received within the recess 30 is an elongated transversely extending gauge member or gauge bar 35 comprising an elongated top wall or top wall portion 36 from which depend a plurality of uniformly transversely spaced lands 37 between which are formed hook slots 38. The hook slots 38 are uniformly transversely spaced at the same gauge as the needle gauge and are disposed in parallel vertical planes, so that the hook slots 38 extend from front-to-rear completely through the gauge member 35 and open through the bottom portion of the gauge member 35.

The front-to-rear dimension of the gauge member 35 is disclosed in the drawings as being approximately equal to the front-to-rear dimension of the recess 30. The height of the gauge member 35 is slightly less than the height of the recess 30, and the height of the gauge member 35, as well as the height of the recess 30 is substantially less than the height of the hook bar 20, so that the major portion of the hook bar 20 is of solid material and lends substantial strength and stability to the holding of looper hooks 40 and 40′ within the hook bar 20.

Each looper hook 40 has a body portion including a substantially elongated, relatively straight, rearward projecting shank or shank portion 41 adapted to fit within the major portion of the corresponding hook slot 38. The neck or head 42 of the looper hook 40 forming a part of the body portion defines a rear vertical surface or shoulder 43 which intersects the shank portion 41. Projecting forward from the neck or head 42 of the looper hook 40 is an elongated bill 44 having a barbed free end portion 45 and defining a bottom cutting edge 46 intersecting the throat 47.

The rear face 29 of the hook bar 20 is adapted to snugly seat within a transverse recess formed in the front face of the shim bar 21. The hook bar 20 is held securely against the shim bar 21 by a plurality of transversely spaced bolts 50 extending through the bracket 22.

The shank portions 41 of the looper hooks 40 and 40′ are firmly secured within the hook slots 38 and the recess 30 by means of a plurality of set screws 51 and 52, threaded through corresponding threaded holes 53 and 54. The set screw holes 53 and 54 extend through the angular front face portion 26, upwardly and rearwardly through the solid portion of the hook bar 20 until they intersect the bottom wall 33 of the recess 30. Each of the set screw holes 53 and 54 is in vertical alignment with each of the corresponding hook slots 38, so that each set screw 51 or 52 engages the bottom edge of the shank 41 of a corresponding looper hook 40 or 40′. Tightening of the set screws 51 and 52 against the bottom edges of the shanks 41 forces the top edges of the shanks 41 into firm securing engagement with the bottom surface 56 of the top wall 36, which defines the top or upper surfaces of each corresponding hook slot 38.

Formed on the upper front face portion of the hook bar 20 above the recess 30 are a plurality of transversely spaced stiffener slots 58 including a plurality of transversely spaced lands 59 projecting forward from the face surface 60. The slots 58 are vertically aligned with corresponding hook slots 38. Thus, when each looper hook 40 and 40' is received within the corresponding hook slot 38, preferably, the rear shoulder 43 of each hook 40 fits within a corresponding stiffener slot 58 and bears against the face surface 60 between an opposing pair of lands 59. The stiffener slots 58 provide additional reinforcement for stabilizing the neck portions 42 of the hooks 40.

In the preferred form of the invention, that is, in a staggered needle cut pile tufting machine, the looper hooks 40 cooperating with the rear needles 12 are identical in construction to the looper hooks 40' which cooperate with the front needles 11, except that the bills 44' of the looper hooks 40' are longer than the bills 44 by a length substantially equal to the offset longitudinal spacing between the rows of front needles 11 and rear needles 12. In the preferred form of the invention, the throats 47 of all the loopers 40 and 40' are in transverse alignment, pursuant to the teaching in the Card U.S. Pat. No. 4,003,321, for "CUT PILE APPARATUS FOR STAGGERED NEEDLE TUFTING MACHINE."

Cooperating with each of the looper hooks 40 and 40' is a conventional cut pile knife 62 (FIG. 1) which is adapted to be reciprocated in a conventional manner in synchronism with the reciprocation of the hook bar 20 for cooperation with the respective needles 11 and 12 to catch and cut the yarns 14 and 15 in order to form cut pile loops, not shown.

The modular hook bars 20 are preferably made in sections abutting end-to-end, and the abutting ends overlap a corresponding bracket 22.

It will be noted that the set screws 51 and 52 are staggered in order that each set screw 51 may be in vertical planar alignment with an individual looper hook 40, while each set screw 52 may be set in vertical planar alignment with a hook 40'. Furthermore, each set screw 51 and 52 extends through a threaded portion of solid material in the hook bar 20, substantially through its entire length, until the free end of each set screw penetrates the bottom surface 33 of the recess 30, for engagement with the bottom edge of the shank 41 of a corresponding looper hook 40 or 40'.

For ease of assembly, and to maintain the uniform hook slot gauge, each hook bar 20 may have mating overlapping and recessed end portions, as indicated by the line 64 in FIG. 1.

The looper apparatus 18 made in accordance with this invention enhances the accuracy of the gauge of the looper hooks 40, 40', minimizes the distortions in the hook bar 20, and also minimizes or eliminates any warping or tendency toward expansion by the lands 37 of the respective hook slots 38.

Both the height and the depth of the solid portions of the hook bar 20 provide effective resistance to cantilever forces, not only downward in a clockwise direction in a vertical plane, but also in transverse planes by the exertion of the knives against the looper hooks, and other twisting and sagging forces caused simply by the mere weight and extensive spans of the hook bar 20.

Since the height of the recess 30 is slightly greater than the height of the gauge member 35, clearance is provided between the bottom of the hook shank 41 and the bottom surface 33 of the recess 30 when the set screws 51 and 52 are tightened to force the shank 41 upward and the gauge member 35 against the top surface 31 of the recess 30. Thus, any burrs formed in the bottom of the shank 41, caused by excessive tightening of the set screws 51 and 52, will expand into the clearance in the bottom portion of the recess 30 to eliminate or minimize jamming of the hook shank 41 in the recess 30 or hook slot 38. In this regard, it will be noted in FIG. 1, that the height of each shank 41 is greater than the height of each corresponding slot 38, so that the bottom edge portion of the shank 41 projects into the clearance between the bottom of the gauge member 35 and the bottom recess surface 33.

What is claimed is:

1. A looper apparatus for a multiple-needle tufting machine including looper hooks, each hook comprising a neck portion having an upright rear shoulder, a shank portion projecting rearward from the neck portion, and a bill projecting forward from the neck portion, comprising:

(a) a hook bar of solid material having a front face, a rear face, a bottom surface, and a transverse dimension, (b) an elongated recess opening through the front face of said hook bar, projecting rearward into said hook bar, and extending transversely of said hook bar, (c) said recess having a top surface and a bottom surface, (d) an elongated unitary gauge member having front, rear, upper and lower portions, and received within said recess, the longitudinal axis of said gauge member extending transversely of said recess, (e) a plurality of transversely spaced hook slots in said gauge member having the same gauge as the needles in the multiple-needle tufting machine, (f) said hook slots being disposed vertically and extending front-to-rear through said gauge member and opening through the front and lower portions of said gauge member, each of said hook slots being adapted to receive the shank portion of a corresponding looper hook projecting rearwardly into said recess, (g) said gauge member comprising an elongated continuously extending transverse top wall portion having a continuously solid, uninterrupted top surface and defining the closed upper surface of each of said hook slots, the upper surfaces of said hook slots being spaced from the bottom surface of said recess a height slightly greater than the height of the shank portion of the corresponding looper hook received in said corresponding hook slot in operative position; and (h) a set screw means for each hook slot, a threaded hole for each set screw extending at an angle upward from front-to-rear through the bottom portion of said hook bar, each threaded hole being in the same vertical plane as each of said hook slots and intercepting the bottom surface of said recess, so that a set screw threaded through each corresponding hole may be adjusted to bear against the bottom edge of the shank portion of a looper hook in the operative position for holding the top edge of the shank portion against the top surface of the corresponding hook slot within said guage member.

2. The invention according to claim 1 in which the front-to-rear dimension of said recess is greater than the front-to-rear dimension of the shank portion of a corresponding looper hook, said front face of said hook bar comprising a front vertical bearing surface above the recess for engagement by the upright rear shoulder of the corresponding looper hooks, in operative position.

3. The invention according to claim 2 further comprising a plurality of transversely spaced lands projecting forward from said front bearing surface to extend between opposite sides of the neck portions of the corresponding looper hooks in operative position, said lands defining vertical grooves in the same vertical planes as said corresponding hook slots.

4. The invention according to claim 3 in which the vertical dimension of said gauge member is slightly less than the vertical dimension of said recess.

5. The invention according to claim 4 in which the front-to-rear dimension of said gauge member is approximately equal to the front-to-rear dimension of said recess.

6. The invention according to claim 1 in which the multiple-needle tufting machine incorporating said looper apparatus has means for supporting a base fabric for longitudinal movement in a tufting direction through said machine, a plurality of transversely spaced reciprocal needles for introducing yarns through said base fabric to form loops, and further comprising means mounting said hook bar transversely below the plane of the base fabric for longitudinal reciprocal movement between an operative position below the needles and an inoperative position, a plurality of said looper hooks, the shank portion of each looper hook being received in a corresponding hook slot within the recess of said hook bar in said operative position.

7. The invention according to claim 1 in which the bottom surface of said hook bar comprises an angular surface inclining forward and upward and intersecting said front face, said threaded holes being formed through said angular surface.

* * * * *